US005243887A

United States Patent [19]

Bonge, Jr.

[11] Patent Number: 5,243,887

[45] Date of Patent: Sep. 14, 1993

[54] DISK CASING PUNCH TOOL AND METHOD

[76] Inventor: Nicholas J. Bonge, Jr., 1183 Pittsfield La., Ventura, Calif. 93001

[21] Appl. No.: 510,149

[22] Filed: Apr. 17, 1990

[51] Int. Cl.[5] ..... B26F 1/02

[52] U.S. Cl. ..... 83/54; 83/467.1; 83/588; 83/633; 83/689; 83/948

[58] Field of Search ..... 83/588, 589, 601, 605, 83/633, 684, 689, 30, 948; 206/313, 444

[56] References Cited

U.S. PATENT DOCUMENTS

| | | | |
|---|---|---|---|
| 847,167 | 3/1907 | Derry | 83/633 X |
| 2,788,854 | 4/1957 | Brandt | 83/633 X |
| 3,355,975 | 12/1967 | Anfuso | 83/633 X |
| 3,385,152 | 5/1968 | Brown et al. | 83/633 |
| 4,257,300 | 3/1981 | Muzik | 83/689 X |
| 4,568,994 | 2/1986 | Lynch | 206/313 X |
| 4,594,927 | 6/1986 | Mori | 83/633 X |
| 4,739,687 | 4/1988 | Wanner et al. | 83/689 X |
| 4,763,552 | 8/1988 | Wagner | 83/689 |

OTHER PUBLICATIONS

Double Disk Ad, Biological Engineering, Inc., Computer Shopper, Dec. 1988, p. 609.

Double Disk Ad, Biological Engineering, Inc., Computer Shopper, Mar. 1989, p. 404.

Double Disk Ad, Biological Engineering, Inc., Computer Shopper, Jul. 1989, p. 629.

Double Disk Ad, Biological Engineering, Inc., Computer Shopper, Mar. 1990, p. 440.

*Primary Examiner*—Frank T. Yost
*Assistant Examiner*—Rinaldi Rada
*Attorney, Agent, or Firm*—Christie, Parker & Hale

[57] ABSTRACT

A punching tool for piercing a hole through the substantially parallel, spaced apart plates of a data storage disk casing uses a die which supports one of the plates and an elongated punch which pierces through the plates in succession. The disk is placed on a tray on the punch's base, and a drive lever is pushed downward to drive the punch through the casing plates. The punch is guided so that it moves along its axis of elongation and has a cutting surface at its end with a point to begin the hole in each of the plates and a trailing edge spaced apart from the point which completes the hole. The distance between the point and the trailing edge is great enough to allow the point to begin a hole in a succeeding plate before the trailing edge completes the hole in the previous plate.

27 Claims, 6 Drawing Sheets 60
70
66

DISK CASING PUNCH TOOL AND METHOD

FIELD OF THE INVENTION

The present invention pertains to the field of data storage disk casings and, more particularly, to a punch tool for piercing a hole through the brittle, spaced apart plates of a data storage disk casing.

BACKGROUND OF THE INVENTION

Microcomputers and other computers frequently use a magnetic data storage disk enclosed in a casing which can be inserted and withdrawn from a disk drive to enter data into the computer or transfer data from one computer to another. Currently, a very popular form of these disks is the 3½ inch diskette. These diskettes have a round magnetic data storage disk within a brittle plastic casing. The casing has a top layer and a lower layer and is sealed around the edges in order to protect the disk from the outside environment. A sliding metal sleeve covers a portion of the disk and is pulled back by the disk drive in order to read data to and from the disk. These disks are sold in two formats, double density and high density. A high density disk stores twice the data that a double density disk does. Normally, either type of disk can be inserted into the same disk drive. The casings for the two disks are identical except for a hole molded into the high density disk casing which is not present in the double density disk casing. The disk drive detects the presence of this molded-in hole and formats the data differently when the hole is present.

In order to minimize production costs, the only differences between most high density 3½ inch diskettes and most double density 3½ inch diskettes are the quality control which they must pass and the casing in which they are mounted. In order to save production costs, high density and double density disks are usually produced in exactly the same way on the same production line. However, high density disks, having passed a more stringent quality control test, typically cost two or three times as much as double density disks.

As a result, it would be desirable to alter the casing of a double density disk so that the disk drive would treat the disk as a high density disk. Since the disks are essentially identical except for the casing, and twice as much data can be stored on a high density disk, the cost of and number of disks needed for any particular task could be significantly reduced. Unfortunately, it is quite difficult to alter the molded casings. The disk casings are typically made from a virtually rigid, brittle plastic material which is difficult to cut without cracking, bending or deforming the casing material. If the casing is cracked or bent, data cannot be read properly. If small casing particles, produced when the disk is cut, contact the magnetic storage disk within the casing, then the disk is destroyed. In addition, to maintain the integrity of the casing, it is best if the casing edge is not cut but instead a hole is cut in the disk spaced apart from the disk's edge.

SUMMARY OF THE INVENTION

The present invention allows a double density disk to be reformatted for treatment as if it were a high density disk by punching a hole through a casing which has been molded without one. The hole is pierced through the two walls of the casing without cracking, discoloring or significantly deforming either the unsupported upper wall of the casing or the supported lower wall of the casing.

In a preferred embodiment, the present invention is a tool for piercing a hole through substantially parallel spaced apart plates of a data storage disk casing with a die for supporting one of the plates and an elongated punch for piercing the plates. The punch is adapted to move relative to the die so that holes are pierced through the parallel plates in succession. The punch has a cutting surface oriented toward the plates with a point for beginning the hole in each plate and a trailing edge spaced apart from the point for completing the hole. The distance between the point and the trailing edge is great enough to allow the point, when in use, to begin a hole in a succeeding plate before the trailing edge completes the hole through the previous plate.

Preferably the cutting surface is a substantially planar surface which forms an angle with the punch's axis of elongation. The point is preferably one edge of the planar surface, and the trailing edge is the opposite edge of the planar surface. Alternatively, the cutting surface can have two distinct spaced apart ridges making up the point, with the trailing edge between the two ridges. The surface between the ridges may be shaped as two distinct planar surfaces which intersect at the trailing edge, or as a curved surface extending from one ridge to the other. Preferably the punch has a guide for supporting the punch and restraining its movement to a direction parallel to its axis of elongation toward and away from the die. A drive lever with a handle end drives the punch toward the die, the drive lever creating a mechanical advantage preferably of at least 7:1. A casing guide aligns the casing with respect to the die, preferably by contacting the outer edges of the casing and holding them in place.

In another embodiment, the present invention is a tool for piercing a hole through substantially parallel, brittle, spaced apart plates of a data storage disk casing with a die for supporting one of the rigid plates, the die having a hole adjacent the supported plate, and an elongated punch for piercing the rigid plates. The punch pierces the plates by movement along its axis of elongation toward the die and through the hole in the die. A guide restrains nonaxial movement of the punch. The punch is adapted to move through the hole in the die, and the difference between the cross-sectional area of the punch and the area of the hole is preferably large enough to prevent the supported plate from cracking, yet small enough to prevent the supported plate from being permanently deformed. Typically this difference is approximately 0.05 mm.

The invention also comprises a method for piercing a hole through first and second substantially parallel, spaced apart plates of a data storage casing. A leading edge of a punch is driven through the first casing plate. A trailing edge of the punch is driven toward the first casing plate. The leading edge of the punch is driven into the second casing plate before the trailing edge of the punch is driven through the first plate. The leading edge of the punch is driven through the second plate, and the trailing edge of the punch is driven through the second plate.

In another embodiment, the present invention is a method for piercing a hole through substantially parallel, brittle, spaced apart plates of a data storage disk casing. The casing is aligned on a die. An elongated punch is driven in a direction parallel to its axis of elongation toward the die and into the casing plates. The punch is driven in the same direction through the casing plates and through a hole in the die, and the punch is withdrawn from the hole in the die and from the casing.

DETAILED DESCRIPTION

Figure 1:
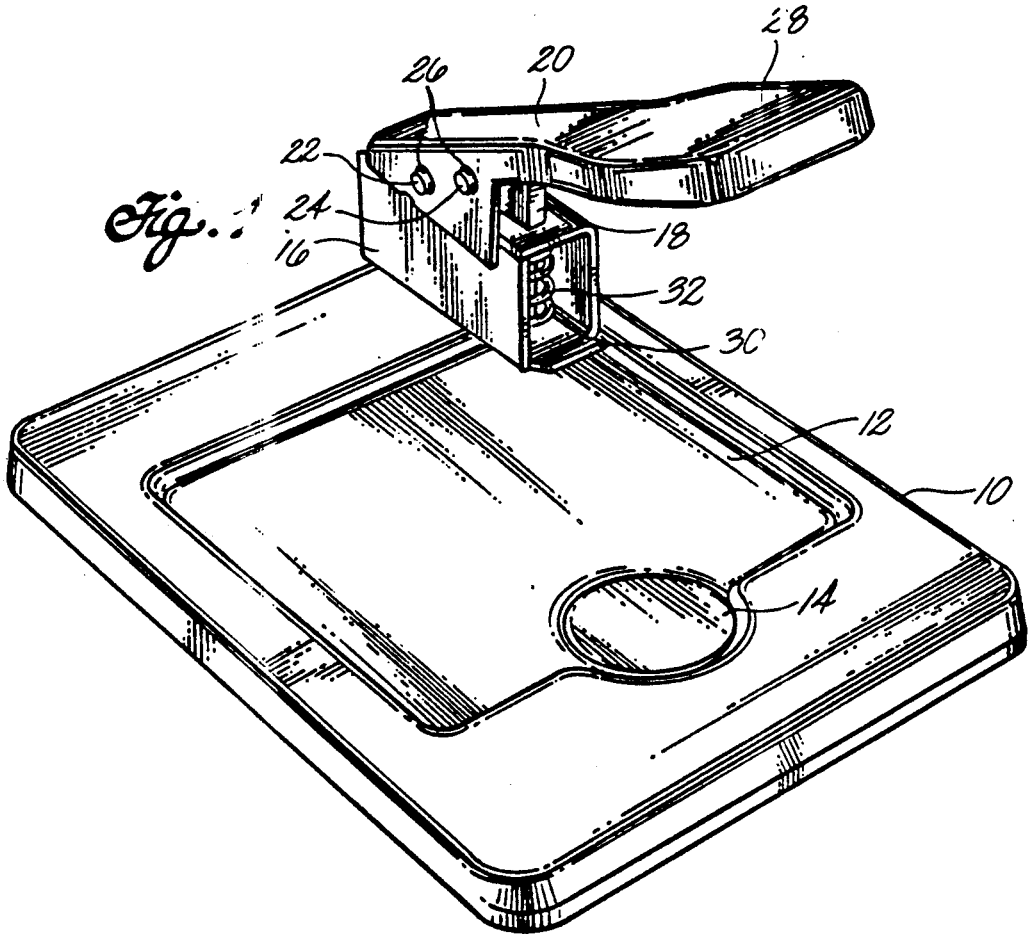
FIG. 1 is a perspective view of a punch tool according to the present invention.
Figure 2:
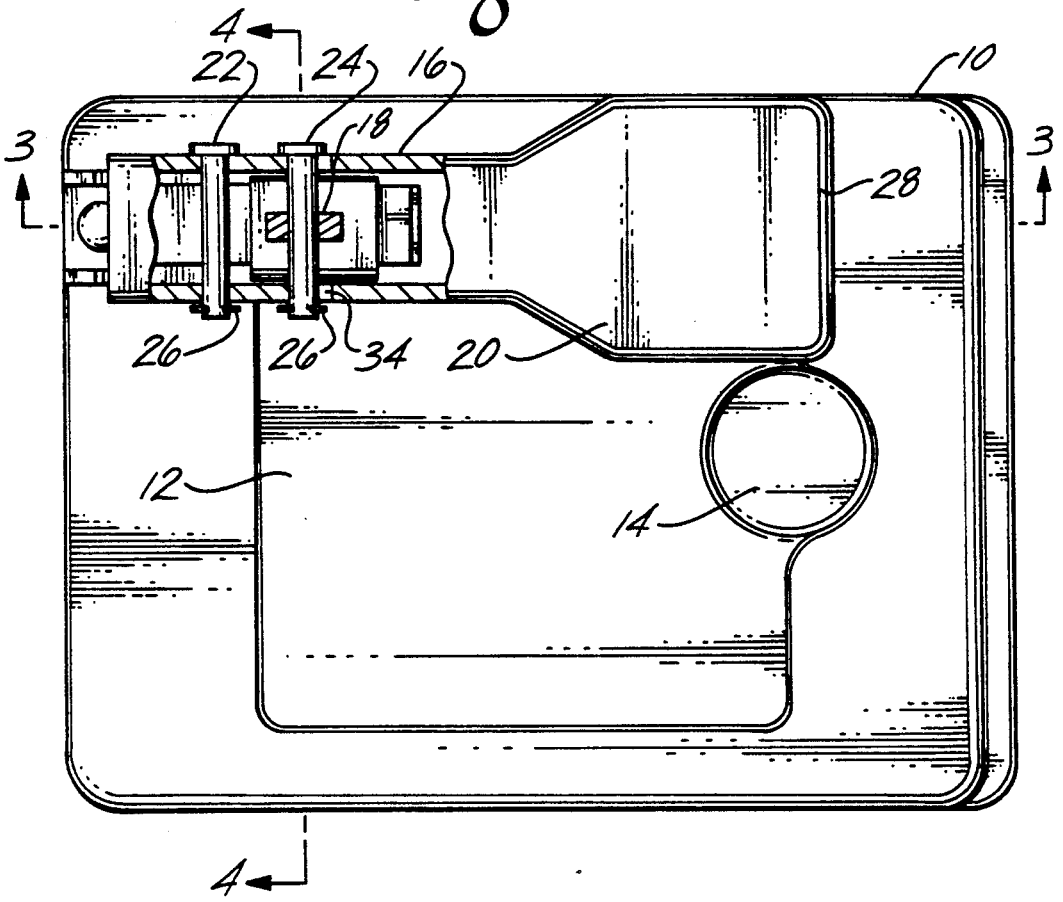
FIG. 2 is a top plan view, partially cut away, of the tool of FIG. 1.
Figure 6:
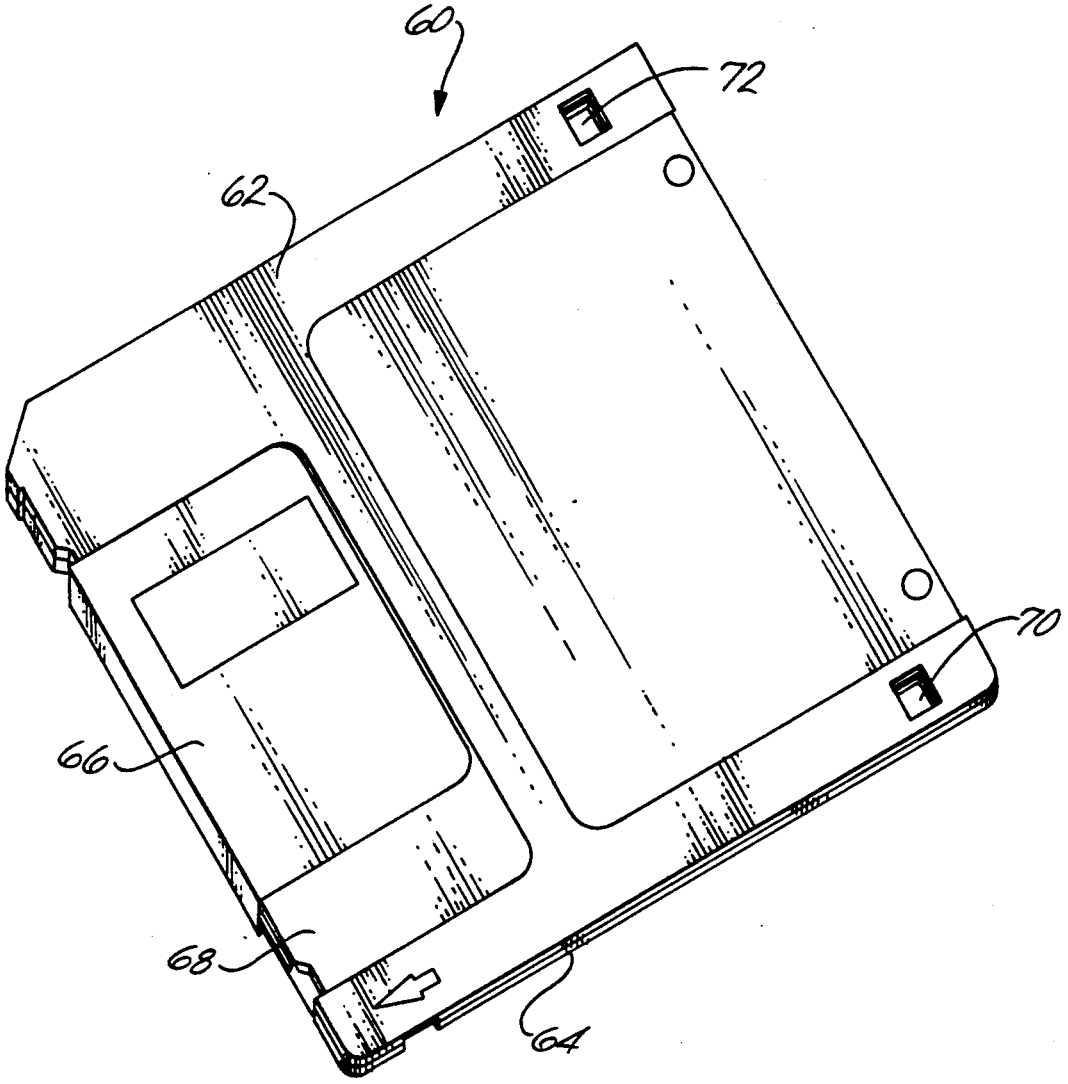
FIG. 6 is a perspective view of a 3½ inch disk casing upon which the tool of FIG. 1 operates.
Figure 7:
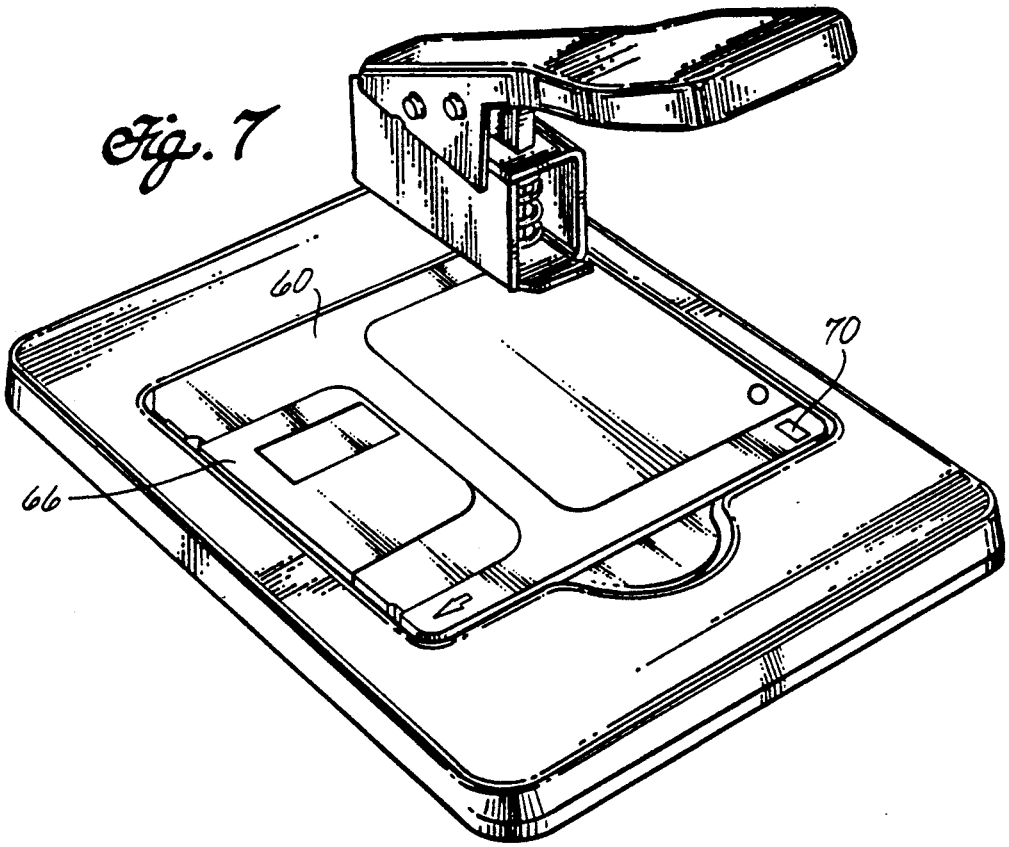
FIG. 7 is a perspective view similar to that of FIG. 1 showing a disk casing inserted into the tray.

The present invention is a punch tool designed specifically to cut through the brittle plastic casing of a 3½ inch magnetic storage diskette without damaging the casing and without creating small particles which can work their way toward the magnetic storage medium and interfere with the operation of the disk. The tool has a base 10 with a central storage tray 12. The storage tray is designed to hold the disk's casing while it is being operated upon as shown in FIGS. 6 and 7. The tray has a round depression 14 below the bottom layer of the tray to allow the disk to be more easily inserted and removed from the tray. A punch bracket 16 is fastened to the base. This bracket holds a punch 18 and a drive lever 20. The drive lever is connected to the bracket with a hinge pin 22 about which it rotates. The drive lever is connected to the punch 18 with a punch pin 24. Retaining rings 26 hold the pins in place. A handle end 28 of the drive lever 20 opposite the hinge pin allows the drive lever to be comfortably operated by hand. The bracket has a lip 30 close to the tray which guides the disk into its proper location under the punch. A spring 32 mounted within the bracket biases the drive lever upwards and the punch away from the tray. As best shown in FIG. 2, the punch pin 24 fits into a slot 34 in the drive lever. Since the drive lever pivots about the hinge pin 22, and the punch 18 moves only vertically up and down, the slot 34 is necessary to allow the punch pin to move as the drive lever is pivoted.

Figure 3:
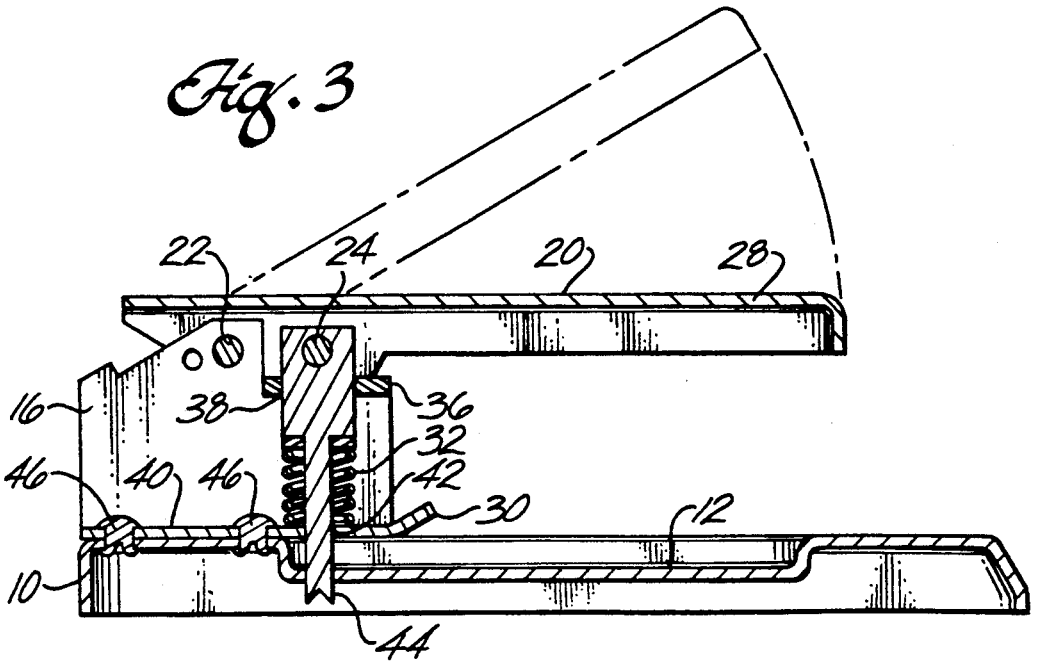
FIG. 3 is a cross-sectional view of the tool of FIG. 2 taken along lines 3—3.

As shown in FIG. 3, the bracket 16 has an upper plate 36 with a guide slot for the punch 18. The bracket also has a lower plate 40 with a second guide slot for the punch 42. These slots 38, 42 precisely control the movement of the punch so that it moves only vertically with respect to the tray 12. As also can be seen in FIG. 3, the tray includes a hole 44. This hole together with the tray make up the die. When the drive lever is pressed downward, the punch is driven toward the die and through the hole 44 in the die surface or tray bottom 12.

When the drive lever handle is pushed downward, the spring 32 is compressed. When the handle is then released, the spring pushes the punch upward away from the die and the disk which has been inserted into the tray, pushing the drive lever back upward. If, however, the force of the spring is not sufficient to draw the punch out of the disk, the underside of the handle end of the drive lever can be grasped and pulled away from the base upwards. Since the punch is connected to the handle with the punch pin 24, the punch can be manually, positively returned to its starting position up away from the tray.

FIG. 3 also shows rivets 46 which fasten the bracket 16 to the base 10. While rivets are presently preferred for fastening the bracket to the base, the bracket can be attached in a variety of other ways including adhesives and weld points. Alternatively, the bracket and tray could be formed as a single piece.

Stamped steel is presently preferred for the drive lever, bracket and tray, while the punch is machined. Steel is rigid, lightweight, strong and reasonably priced. A variety of other materials can be used, however, provided they allow the necessary strength and precision.

Figure 5A:
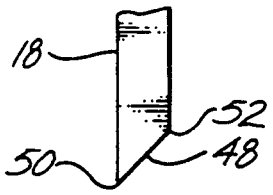
FIG. 5A is a side elevation view of a punch suitable for use in the present invention.

The preferred shapes for the punch are shown in FIGS. 5A, 5B, 5C, 5D and 5E. The punch has a cutting surface 48 with a point 50 and a trailing edge 52. The point 50 is the portion which initially contacts the first disk casing plate which is to begin the hole. The trailing edge 52 is the portion which completes the hole. In FIG. 5A, the surface between the point 50 and the trailing edge 52 is substantially planar and angled with respect to the punch's axis of elongation. The vertical distance between the point and the trailing edge is sufficient so that the point contacts the bottom plate of the casing before the trailing edge 52 is pushed all the way through the upper plate of the casing.

Figure 5B:
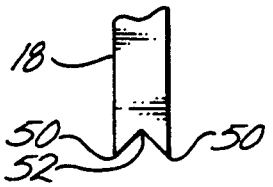
FIG. 5B is a side elevation view of an alternative punch for use in the present invention.
Figure 5C:
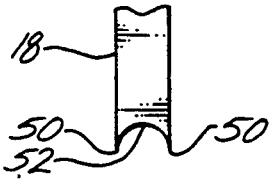
FIG. 5C is a side elevation view of another alternative punch for use in the present invention.

In FIG. 5B, the point 50 has two ridges on opposite sides of the punch. A substantially planar surface extends upwards from each side and towards the center of the punch's cutting surface. The trailing edge 52 is located between the two ridges at a point where the substantially planar surfaces intersect. These planar surfaces are offset at an angle from the axis of elongation of the punch. The angle is chosen so that the distance between the trailing edge and the ridges is sufficient to allow the ridges to contact the bottom plate of the casing before the trailing edge is pushed all the way through the upper plate. FIG. 5C shows a punch similar to that of FIG. 5B except that, instead of planar surfaces intersecting to form the trailing edge 52, a curved surface joins the ridges to each other. The peak of this curved surface defines the trailing edge of the punch. The curved surface can be cylindrical as shown or it may assume a parabolic or some other shape.

Figure 4:
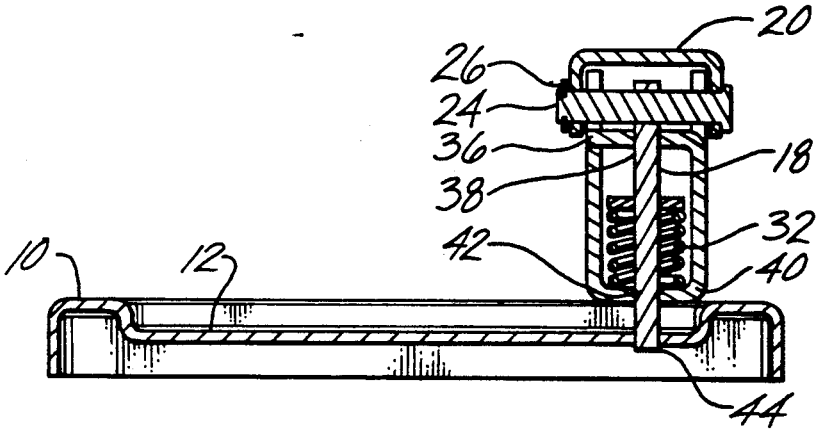
FIG. 4 is a cross-sectional view of the tool of FIG. 2 taken along lines 4—4.
Figure 8:
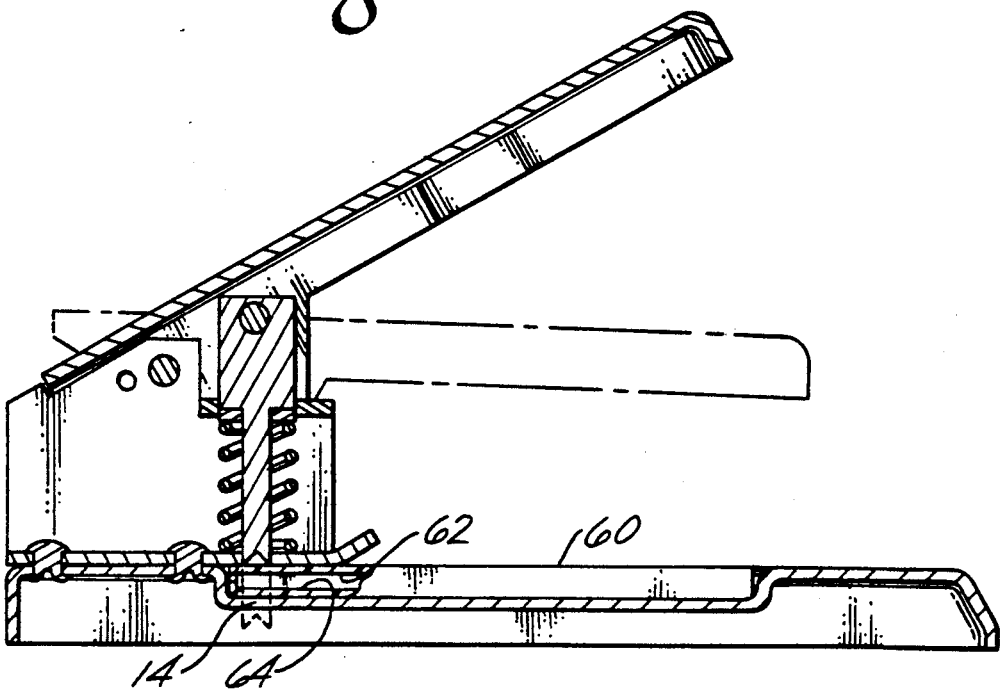
FIG. 8 is a cross-sectional view similar to that of FIG. 3 showing a disk placed in the disk tray and partially cut away.
Figure 5D:
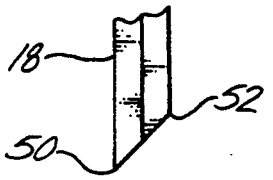
FIG. 5D is an elevation view of a corner of a third alternative punch for use in the present invention.
Figure 5E:
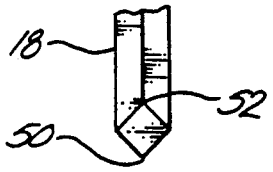
FIG. 5E is an elevation view of the punch of FIG. 5D from a different corner rotated 90°.

FIGS. 5D and 5E show a punch in which the cutting surface is substantially planar and angled with respect to the punch's axis of elongation similar to the punch of FIG. 5A. In FIG. 5A, however, as in FIGS. 5B and 5C, the point 50 is actually a line. In the punch of FIGS. 5D and 5E, the cutting surface has a point 50 at one corner, the point is closer to being a point in the geometrical sense of that word rather than a ridge or line as in the other punches. This allows the punch to more easily pierce the plastic material of the casing. The trailing edge 52 occurs at the opposite corner of the cutting surface. The configuration of FIG. 5B is presently preferred for use in the tool as shown in FIGS. 3, 4 and 8. However, serviceable results may also be obtained with the punches shown in the other drawings.

FIG. 6 shows a standard 3½ inch magnetic storage disk casing which is the work piece for the present invention. The casing 60 has an upper plate 62 and a lower plate 64. The two plates are formed of a brittle, semi-rigid plastic material which is glued or welded together with a space in between to allow the magnetic storage disk to rotate inside. The plates each have a lip which surrounds the space between the plates to seal out any foreign particles. A metal sleeve 66 slides within a slot 68 to cover or reveal the magnetic storage medium inside the casing, and an erase protect tab 70 allows the user to signal the disk drive not to write data over that which is already recorded on the disk. Opposite the erase protect tab is a hole 72. In high density disk casings, this hole is a molded part of the casing which is present when the casing is assembled. In double density casings, this hole is not present. The upper and lower disk casing plates are substantially flat in this region. When the disk is inserted into its disk drive, the drive detects the presence or absence of this hole 72 and, from that, determines whether the disk should be treated as a high density disk, typically with a 1.44 megabyte storage capacity, or as a double density disk with a 720 kilobyte storage capacity.

To convert a double density disk into a high density disk using a tool constructed according to the present invention, the disk is placed into the tray 12 of the tool as shown in FIG. 7. The tray conforms to the shape of the disk casing so that the casing is held firmly in place by its edges within the tray under the punch 18. The tray aligns the disk in its proper location with respect to the hole 14 in the tray. With the disk properly aligned against the die and positioned below the punch, the drive lever 20 is pushed downward by its handle end. This drives the point of the punch into the first plate of the disk casing. The point pierces through the casing and is followed by the remainder of the punch's cutting surface. As this cutting surface continues to penetrate through the disk casing, the point hits the second plate of the disk casing. The proportions of the punch and its relative position as it is driven through the upper and lower casing plates are shown in FIG. 8. After the point of the punch pierces the lower plate, which is the plate supported on the tray 12, the trailing edge 52 of the punch is pushed completely through the first plate of the casing, completing the hole in the first plate. As the punch is driven further downward, the cutting surface finally completes the hole through the second plate and is pushed all the way through the hole in the die. When the hole is completed, the drive lever is released and the spring pushes the punch back up into the bracket. The double density disk now has a hole in its casing which signals to the disk drive that it is a high density disk and its data storage potential has been doubled.

This seemingly simple punching operation is made particularly difficult in part because of the brittle, semi-rigid materials from which the casing is made and in part because only one of the casing plates can be supported. The bottom casing plate rests against the die 12, but the top casing plate rests only against the lip of the bottom casing plate. This leaves nothing to support the casing plate around the punch where it is being pierced. These problems are overcome in part by the shape of the punch as shown in FIGS. 5A, 5B and 5C. It is also approached by providing the correct tolerance between the punch and the hole in the die 14.

The material punched from the disk casing is pushed through the hole in the die, both from the upper plate as well as the lower plate. If the difference between the cross-sectional area of the punch and that of the hole is too great, then the plate material will bend. In the worst case, this can cause cracking, either breaking the casing open or allowing dust and other foreign materials to contact the magnetic storage medium within the casing. If the distance is decreased, it can still allow the casing to flex enough to bend and discolor. This permanently deforms the shape of the disk which can cause the magnetic storage medium to strike the casing as it rotates, also destroying the data stored on the disk. If the casing material is bent only a little, it becomes discolored and significantly more brittle. While this does not destroy the storage capabilities of the disk, it undermines the durability of the casing. On the other hand, if the difference between the cross section of the punch and the cross section of the hole through which the punch is driven is too small, then the plate material, rather than cutting cleanly, will be fragmented and a large number of very fine particles will be created. These particles become a dust inside the casing which can infiltrate the casing and move their way toward the disk, destroying any data stored there. It has been found, with a standard 3½ inch magnetic storage disk composed from the standard semi-rigid plastic materials common in the industry, that a clearance between the punch and the hole of 0.05 mm produces the best results. Dust and discoloration are minimized.

It is also important that the punch move swiftly through the casing to produce the holes through the casing. When the punch is to be operated by hand as shown in the illustrated embodiments, this can only be done if the user is given a significant mechanical advantage on the punch. The drive lever, therefore, is long enough so that at the handle end the force supplied at the punch is eight times that supplied at the end of the lever. If the mechanical advantage is significantly less than 8:1, it will be difficult for the user to punch the hole quickly enough to minimize the dust created and the damage to the disk casing. This problem can be solved in a variety of other ways as well. For example, the drive lever could be replaced with an electric or hydraulic drive system which avoided the human user entirely. It would still be necessary, however, that the mechanical or hydraulic drive mechanism punch through the casing quickly.

While only a few embodiments have been shown here, the inventor intends in no way to abandon the many possible variations and modifications which would be apparent to a person skilled in the art. The precise arrangement of the punch guide and driving mechanism can be significantly altered without affecting the usefulness of the tool. In addition, a variety of different guiding arrangements for the disk are possible instead of the tray depicted in the drawings. For example, a right angled slot can be used instead of the tray. The disk would then be inserted into the slot, and the bottom surface of the slot would form the die against which the disk is cut. In addition, a great variety of different arrangements can be provided to connect the drive lever to the punch and to mount the two to the bracket.

What is claimed is:

1. A method for piercing a high density disk indicator hole through first and second substantially parallel semi-rigid spaced apart plates of a 3½ inch data storage disk casing comprising:

placing a lower density 3½ data storage disk casing onto a tray including a die opening;

aligning the data storage disk casing at a fixed location on the tray with the die opening corresponding to the location for a high density disk indicator hole in a high density 3½ inch data storage disk casing;

driving a leading edge of a punch through the first casing plate;

driving a trailing edge of the punch toward the first casing plate;

driving the leading edge of the punch into the second casing plate after driving the leading edge through the first plate;

driving the trailing edge of the punch through the first plate after driving the leading edge into the second plate;

driving the leading edge of the punch through the second plate;

driving the trailing edge of the punch through the second plate; and wherein the driving steps are performed sufficiently rapidly to avoid significant bending of either plate or creation of particles from either plate; and removing the disk casing from the tray.

2. The method of claim 1 comprising driving the punch through a hole in the die after driving the leading edge of the punch through the second plate.

3. The method of claim 1 comprising driving the punch with a drive lever which provides a mechanical advantage to the punch.

4. A method for piercing a high density disk indicator hole through substantially parallel, brittle, spaced apart plates of a 3½ inch data storage disk casing comprising:

placing a lower density 3½ inch data storage disk casing onto a die;

aligning the casing on the die with the location for a high density disk indicator hole adjacent to an elongated punch;

driving the punch in a direction parallel to its axis of elongation toward the die and into the casing plates;

further driving the punch in the same direction through the casing plates and through a hole in the die for producing a high density disk indicator hole through the data storage disk casing, the driving steps being sufficiently rapid for avoiding significant bending of the casing or creation of particles from the casing; and withdrawing the punch from the hole in the die and from the casing; and removing the disk from the die.

5. The method of claim 4 comprising driving the punch using a drive lever creating a mechanical advantage on the punch.

6. A tool for piercing a high density disk indicator hole through substantially parallel spaced apart semi-rigid plates of a 3½ inch data storage disk casing at a predetermined location on the casing spaced apart from an edge of the casing comprising:

a tray for supporting one of the plates;

a die opening adjacent the tray;

a guide having two edges above the bottom of the tray for engaging a corner of the 3½ inch data storage disk casing for aligning at least two edges of the disk casing at a predetermined location and orientation on the tray with the die opening adjacent to the location of a high density disk indicator hole;

an elongated punch for piercing the semi-rigid plates adapted to move relative to the tray so that holes are pierced through the parallel plates of the data storage disk casing in succession, the punch having a cutting surface oriented toward the plates with a point for beginning the hole in each plate and a trailing edge spaced apart from the point for completing the hole, the distance between the point and the trailing edge being great enough to allow the point, when in use, to begin a hole in a succeeding plate of the data storage disk casing before the trailing edge completes the hole through the previous plate of the data storage disk casing;

the punch being at a fixed location relative to the intersection of the two edges of the casing for punching a hole in the 3½ inch data storage disk casing at a location corresponding to the indicator hole location in the high density 3½ inch data storage disk casing; and means for advancing the punch towards and through the die opening for piercing a hole through both semi-rigid plates of the 3½ inch data storage disk casing without significant bending of either plate or creating particles from the casing plates.

7. The tool of claim 1 wherein the cutting surface comprises a substantially planar surface, the plane of the surface forming an angle with the punch's axis of elongation, the point comprising one edge of the surface and the trailing edge comprising an opposite edge of the surface.

8. The tool of claim 1 wherein the cutting surface point comprises two distinct spaced apart ridges and the trailing edge is between the two ridges.

9. The tool of claim 8 wherein the cutting surface comprises two distinct planar surfaces extending each from the trailing edge to a respective one of the two ridges.

10. The tool of claim 8 wherein the cutting surface comprises a curved surface extending from one ridge to the trailing edge and then to the other ridge.

11. The tool of claim 10 wherein the curved surface has a circular cross section.

12. The tool of claim 6 comprising a punch guide for supporting the punch and substantially restraining its movement to a direction parallel to its axis of elongation towards the die.

13. The tool of claim 6, wherein said means for advancing comprises a drive lever with a handle end for driving the punch towards the die, the drive lever creating a mechanical advantage between the handle end and the punch.

14. The tool of claim 13 wherein the mechanical advantage is at least seven to one.

15. A tool for piercing a high density disk indicator hole through substantially parallel, brittle, spaced apart plates of a 3½ inch data storage disk casing comprising:

a die for supporting one of the rigid plates, the die having a tray for retaining one of the rigid plates and a hole adjacent the supported plate;

means for locating a corner of the casing so that the location for a high density disk indicator hole on the casing is opposite the die hole;

an elongated punch for piercing the rigid plates by movement along its axis of elongation towards the die and through the hole, the punch having a rectangular transverse cross-section; and a guide for restraining nonaxial movement of the punch.

16. The tool of claim 15 wherein the punch comprises a cutting surface at one end which contacts the plates for piercing therethrough, the cutting surface having a point which initially contacts the plates and a spaced apart trailing edge which follows the point into contact with the plates, the distance between the point and the trailing edge being at least as great as the space between the casing plates.

17. The tool of claim 16 wherein the cutting surface comprises a substantially planar surface between the point and the trailing edge, the planar surface forming an angle with respect to the axis of elongation of the punch.

18. The tool of claim 16 wherein the cutting surface point comprises two ridges and the trailing edge is located between the two ridges.

19. The tool of claim 15 wherein the punch is adapted to move through the hole in the die, and the distance between the punch exterior and the edges of the hole when the punch extends into the hole is great enough to prevent the supported plate from cracking.

20. The tool of claim 15 wherein the punch is adapted to move through the hole in the die, and the distance between the punch exterior and the edges of the hole when the punch extends into the hole is small enough to prevent the supported plate from being permanently deformed.

21. The tool of claim 15 wherein the punch is adapted to move through the hole, and the distance between the punch exterior and the edges of the hole when the punch extends into the hole is approximately 0.05 mm.

22. The tool of claim 15 comprising a drive lever with a handle end for driving the punch toward the die and creating a mechanical advantage between the handle end of the drive lever and the punch.

23. The tool of claim 22 wherein the mechanical advantage is at least seven to one.

24. The tool of claim 22 wherein the drive lever is connected to the punch so that pulling the drive lever away from the pulls the punch away from the die.

25. The tool of claim 15 comprising a base containing the tray and wherein the guide for restraining the punch is fastened to the base.

26. The tool of claim 25 wherein the guide is fastened to the base adjacent the tray and the guide comprises a lip for guiding a casing towards the punch.

27. The tool of claim 15 comprising means for biasing the punch away from the die.

* * * * *

UNITED STATES PATENT AND TRADEMARK OFFICE

CERTIFICATE OF CORRECTION

PATENT NO. : 5,243,887

DATED : September 14, 1993

INVENTOR(S) : Nicholas J. Bonge, Jr.

It is certified that error appears in the above-indentified patent and that said Letters Patent is hereby corrected as shown below:

Column 7, line 5, after "3 1/2" insert -- inch --.

Column 8, line 30, change "claim 1" to -- claim 6 --.

Column 8, line 37, change "claim 1" to -- claim 6 --.

Column 10, line 19, before "pulls the punch" insert -- die --.

Signed and Sealed this

Tenth Day of May, 1994

Bruce Lehman

*Attest:*

BRUCE LEHMAN

*Attesting Officer*

*Commissioner of Patents and Trademarks*